United States Patent [19]
Gotomyo et al.
[11] 4,381,330
[45] Apr. 26, 1983

[54] SURFACE TREATED GLASS-WOOL MAT AND THE METHOD FOR MAKING THE SAME

[75] Inventors: Yasuo Gotomyo, Hiroshima; Yukihiro Nakagawa, Aichi, both of Japan

[73] Assignees: Toyo Kogyo Co., Ltd., Hiroshima; Nakagawa Sangyo Co., Ltd., Aichi, both of Japan

[21] Appl. No.: 289,080

[22] Filed: Jul. 31, 1981

[30] Foreign Application Priority Data

Aug. 2, 1980 [JP] Japan ..... 55-106537

[51] Int. Cl.³ ..... B32B 7/02
[52] U.S. Cl. ..... 428/218; 65/4.4; 65/9; 428/285; 428/288; 428/296; 428/298; 428/299; 428/300; 428/369; 428/371; 428/392; 428/398

[58] Field of Search ..... 428/285, 288, 299, 300, 428/369, 370, 371, 392, 398, 296, 234, 218, 298; 156/82, 148, 181, 296; 264/80; 65/4.4, 9

[56] References Cited

U.S. PATENT DOCUMENTS

| | | | |
|---|---|---|---|
| 2,794,759 | 6/1957 | Dildilian | 428/300 |
| 3,338,777 | 8/1967 | Irwin et al. | 428/300 |
| 3,532,482 | 10/1970 | Weisbart | 65/4.4 |
| 3,575,789 | 4/1971 | Sufert et al. | 65/4.4 |
| 3,684,474 | 8/1972 | Chisholm | 65/112 |
| 4,158,555 | 6/1979 | Kallenborn | 65/2 |
| 4,277,531 | 7/1981 | Picone | 428/300 |

*Primary Examiner*—James J. Bell
*Attorney, Agent, or Firm*—Fleit, Jacobson & Cohn

[57] ABSTRACT

A glass-wool mat is produced from a sheet of glass fibers by heating the surfaces of the sheet to a temperature close to the melting point of glass so that the glass fibers in the surface area have rounded ends and are shrunk so that they are firmly entangled together. Thus, non-irritating surfaces are provided on the mat.

8 Claims, 7 Drawing Figures

SURFACE TREATED GLASS-WOOL MAT AND THE METHOD FOR MAKING THE SAME

The present invention relates to a glass-wool mat and a method for manufacturing the same. More particularly, the present invention pertains to a surface treatment of such glass-wool mat.

A glass-wool mat is generally constituted by a plurality of glass fibers which are entangled with each other to form a sheet including many voids. Such glass-wool mats have widely been used in view of their superiority in thermal insulative and noise absorbing properties. One problem which has been encountered in such glass-wool mats is that ends of glass fibers are exposed at the surfaces of the mats to thereby give irritating feelings to human skins. In order to solve the problem, it has been a usual practice to provide surface coatings on the glass-wool mats. For example, the mat surfaces have been coated by organic or inorganic materials such as starch or polyvinyl acetate. Alternatively, the glass-wool mats have been covered by sheet materials such as vinyl films, non-woven cloths or papers. It should however be noted that the conventional solutions have caused an increase in the manufacturing coats because additional process and material are required to provide such surface coatings.

It is therefore an object of the present invention to provide a glass-wool mat having uncoated but non-irritating surfaces.

Another object of the present invention is to provide a method for forming non-irritating surfaces on a glass-wool mat.

According to the present invention, the above and other objects can be accomplished by a glass-wool mat including a plurality of glass fibers which are entangled with each other to form a sheet having an inner layer and at least one outer layer, said outer layer being comprised of glass fibers having rounded ends and being crimped to provide a stronger entanglement among the fibers. In another aspect of the present invention, there is provided a method for forming a glass-wool mat comprising steps of gathering glass fibers to form a sheet in which the glass fibers are entangled with each other and then heating at least one surface of the sheet to a temperature close to melting point of glass but lower than a temperature wherein structural changes are produced in the glass fibers so that the glass fibers in the surfaces of the sheet are rounded at their ends and crimped to such an extent that the glass fibers are firmly entangled at the surfaces with each other.

The above and other objects and features of the present invention will become apparent from the following descriptions of a preferred embodiment taking reference to the accompanying drawings, in which;

FIG. 2(*b*) is a fragmentary sectional view showing the fibers in the surface area;

Figure 1:
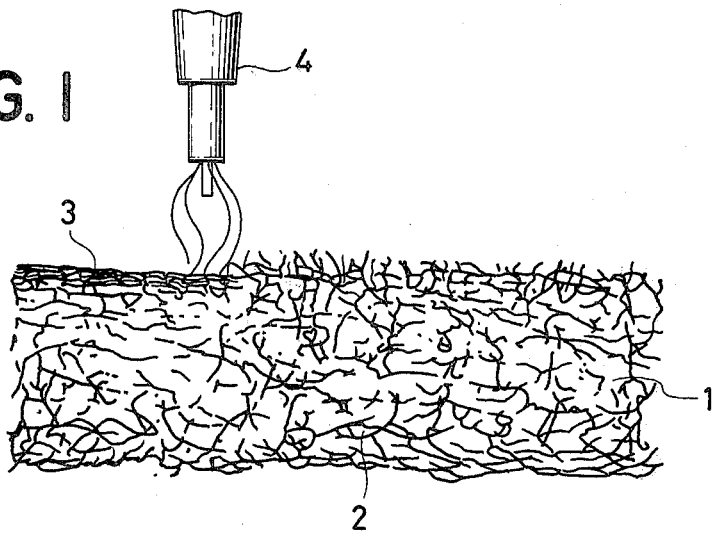
FIG. 1 is a sectional view of a glass-wool mat showing a step of the method in accordance with one embodiment of the present invention.
Figure 3:
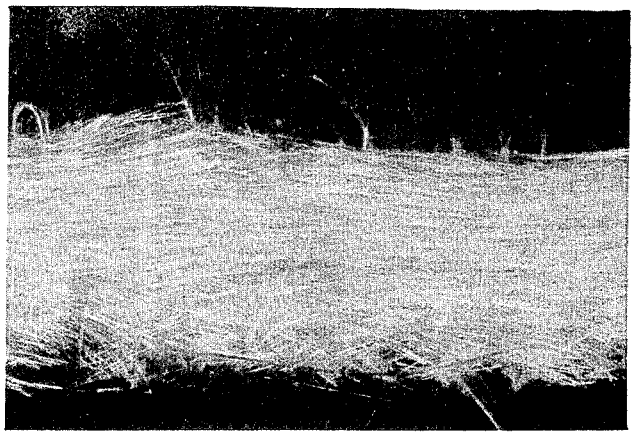
FIG. 3 is a microscopic photograph of a glass-wool mat prior to surface treatment in accordance with the present invention.
Figure 4:
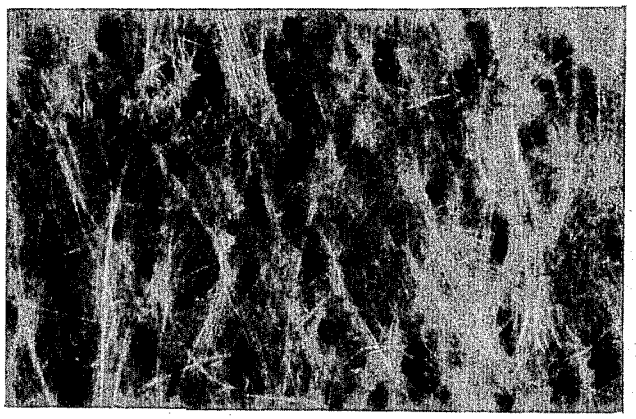
FIG. 4 is a microscopic photograph showing the surface of the mat shown in FIG. 3.

Referring now to the drawings, particularly to FIG. 1, there is shown a process for producing a glass-wool mat. In the process, a plurality of glass fibers 2 having appropriate lengths, for example, fibers of 3 to 150 mm in length are gathered together to form a sheet 1 which is then applied with a known needle punching process in which needles are pierced through the sheet to make the glass fibers entangled with each other. Preferably, the fibers 2 are formed by an alkali-free glass which is essentially consisting of $SiO_2$ and $Al_2O_3$ and does not contain $Na_2O$. Such type of glass is known as having a superior heat resistant property and long filaments of such glass can be gathered together in a form of a sheet without using any binder. FIGS. 3 and 4 show the structure of the sheet 1 thus prepared.

Figure 2:
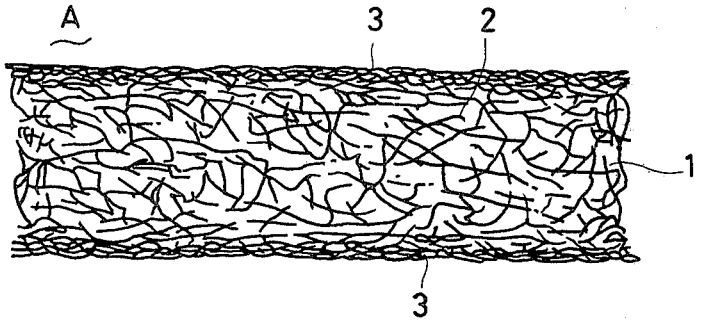
FIG. 2(*a*) is a sectional view of a glass-wool mat in accordance with one embodiment of the present invention.
Figure 2:
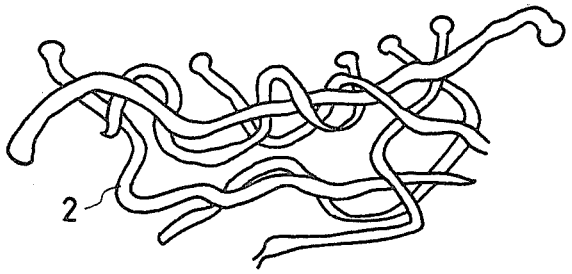

The sheet 1 of the glass fibers 2 is then subjected to heat for example by applying an open flame of a gas burner 4 so that its surfaces are heated to a temperature close to the melting point of the glass. The heating temperature may be in the range between 650° and 900° C., preferably above 800° C. An electrical furnace may be used in lieu of the gas burner 4. By applying the surfaces of the sheet 1 with heat as described above, there are formed as shown in FIG. 2(*a*) outer layers 3 in which glass fibers 2 are shrunk and firmly entangled with each other as shown in FIG. 2(*b*). It will therefore be seen that the glass fibers 2 are more condensed in the outer layer 3 than in the intermediate layer. It will further be seen that the glass fibers 2 in the outer layers 3 have rounded ends so that they will no longer give irritating feelings to human skins. The outer layers 3 provides the sheet 1 with an increased rigidity so that it is no longer necessary to provide outer skins of rigid material such as steel which have often been required in conventional structures. Thus, it becomes possible to decrease the weight of the sheet. The rigidity of the sheet 1 may be controlled as desired by changing the heating time so as to obtain a desired thickness of the outer layer 3.

Figure 5:
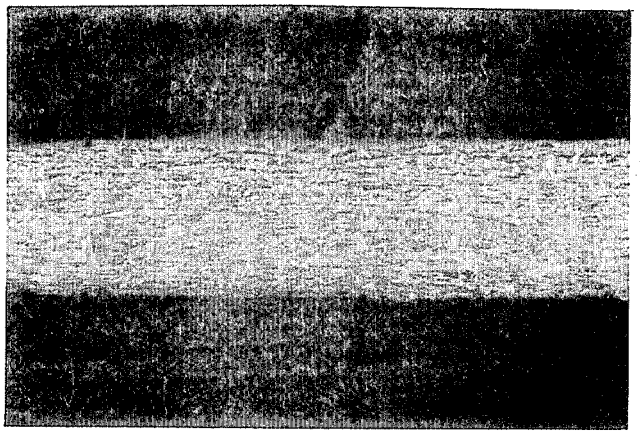
FIG. 5 is a microscopic photograph similar to FIG. 3 but showing the mat after surface treatment; and, FIG. 6 is a microscopic photograph similar to FIG. 4 but showing the mat after the surface treatment.
Figure 6:
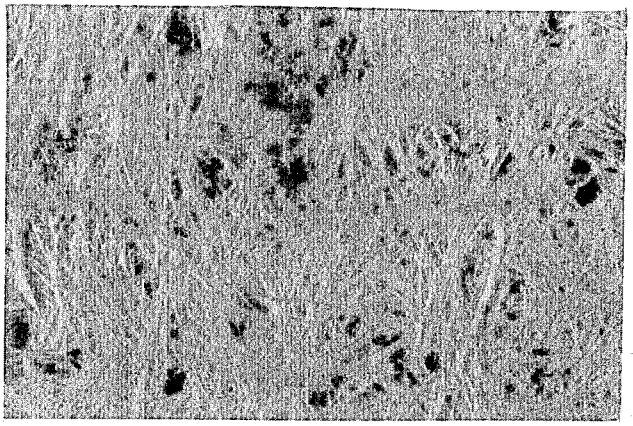

After the heating process, compressed air may be blown to the surfaces of the sheet 1 so that free fibers in the sheet surfaces are removed. Then, the sheet may be subjected to a forming process in which the sheet 1 is impregnated with inorganic or organic binder and formed in a suitable forming die such as a vacuum forming die. After the forming process, the sheet is dried by being applied with heat and thus a mat in accordance with the invention is obtained. FIGS. 5 and 6 show the mat thus obtained. The forming process may be omitted because the sheet 1 has a sufficient rigidity due to the existence of condensed outer layers 3. It should further be noted that, since the sheet 1 is defluffed by the heating process, it becomes possible to paint the surfaces of the sheet.

The invention has thus been shown and described with reference to a specific embodiment, however, it should be noted that the invention is in no way limited to the details of the embodiment but changes and modifications may be made without departing from the scope of the appended claims.

We claim:

1. A glass-wool mat including a plurality of glass fibers which are entangled with each other to form a sheet having an inner layer and at least one outer layer, said outer layer being comprised of glass fibers having rounded ends and being crimped to provide a stronger entanglement among the fibers, the glass fibers in the outer layer being more condensed than those in the inner layer.

2. A glass-wool mat in accordance with claim 1 in which said outer layer is formed on each side of the sheet.

3. A glass-wool mat in accordance with claim 1 in which the glass fibers are of alkali-free glass.

4. A method for forming a glass-wool mat comprising steps of gathering glass fibers to form a sheet in which the glass fibers are entangled with each other and then heating at least one surface of the sheet to a temperature close to melting point of glass but lower than a temperature wherein structural changes are produced in the glass fibers so that the glass fibers in the surfaces of the sheet are rounded at their ends and crimped to such an extent that the glass fibers are firmly entangled at the surfaces with each other.

5. A method in accordance with claim 4 in which the heating temperature is higher than the melting point of glass.

6. A method in accordance with claim 5 in which the heating temperature is above 650° C.

7. A method in accordance with claim 1 in which the heating temperature is above 800° C.

8. A method in accordance with claim 5 which further includes a step of blowing air to the heated surface of the sheet to thereby remove free fibers from the sheet surface.

* * * * *